US009387372B2

(12) United States Patent
Hayashi

(10) Patent No.: US 9,387,372 B2
(45) Date of Patent: Jul. 12, 2016

(54) GOLF CLUB SET

(71) Applicant: DUNLOP SPORTS CO. LTD., Kobe-shi, Hyogo (JP)

(72) Inventor: Kazuhiro Hayashi, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 15 days.

(21) Appl. No.: 14/495,599

(22) Filed: Sep. 24, 2014

(65) Prior Publication Data

US 2015/0087434 A1 Mar. 26, 2015

(30) Foreign Application Priority Data

Sep. 25, 2013 (JP) ..... 2013-198176

(51) Int. Cl.

*A63B 53/04* (2015.01)
*A63B 53/00* (2015.01)
*A63B 53/02* (2015.01)

(52) U.S. Cl.

CPC ..... *A63B 53/0466* (2013.01); *A63B 53/02* (2013.01); *A63B 2053/005* (2013.01); *A63B 2053/042* (2013.01); *A63B 2053/0408* (2013.01); *A63B 2053/0412* (2013.01); *A63B 2053/0437* (2013.01); *A63B 2053/0454* (2013.01); *A63B 2053/0458* (2013.01)

(58) Field of Classification Search

CPC ..... A63B 2053/005; A63B 53/0466; A63B 2053/0408; A63B 2053/0412; A63B 2053/0458; A63B 2053/042; A63B 2053/0454; A63B 2053/0437; A63B 53/02

See application file for complete search history.

(56) References Cited

U.S. PATENT DOCUMENTS 4,128,242 A * 12/1978 Elkins, Jr. ..... A63B 53/00 473/291
6,032,999 A * 3/2000 York ..... A63B 55/10 211/70.2
7,198,575 B2 * 4/2007 Beach ..... A63B 53/04 473/324
8,070,621 B2 * 12/2011 Nakano ..... A63B 53/0466 473/290
2008/0161124 A1 * 7/2008 Kajita ..... A63B 53/0466 473/330
2012/0028727 A1 * 2/2012 Roach ..... A63B 53/047 473/291
2012/0172145 A1 * 7/2012 Kato ..... A63B 53/00 473/345

FOREIGN PATENT DOCUMENTS

JP 2012-61035 A 3/2012

* cited by examiner

*Primary Examiner* — Stephen Blau
(74) *Attorney, Agent, or Firm* — Birch, Stewart, Kolasch & Birch, LLP

(57) ABSTRACT

A golf club set 2 includes a plurality of golf clubs 41 to 45 having different club lengths. Each of the golf clubs 41 to 45 includes a head 6, a shaft 8, and a grip 10. The club length of each of the clubs 41 to 45 is 38.5 inches or greater and 42 inches or less. Face progression of the head 6 is substantially constant. If a moment of inertia of the head about an axis line of the shaft is defined as MI, an MI difference ratio between the adjacent clubs is equal to or less than 3%. Preferably, a loft angle is equal to or greater than 17 degrees in each of all the clubs 41 to 45.

6 Claims, 11 Drawing Sheets

GOLF CLUB SET

The present application claims priority on Patent Application No. 2013-198176 filed in JAPAN on Sep. 25, 2013, the entire contents of which are hereby incorporated by reference.

BACKGROUND OF THE INVENTION

1. Field of the Invention

The present invention relates to a golf club set.

2. Description of the Related Art

A club set including a plurality of clubs has been known. The set includes two or more clubs. Examples of the set include a fairway wood set, a utility type club set, and an iron type club set.

Japanese Patent Application Laid-Open No. 2012-61035 discloses a set including golf clubs having loft angles of 14 degrees to 35 degrees. In the set, face progression is made to be substantially constant under a predetermined condition. Furthermore, in the set, the golf club having an increased loft angle has a decreased angle of a center of gravity. Furthermore, in the set, the golf club having an increased loft angle has an increased distance of a center of gravity.

SUMMARY OF THE INVENTION

It is preferable that all clubs in a set can be swung with the same feeling. It is preferable that impact timings coincide with each other in all the clubs in the set. It is preferable that the directions of hit balls are constant in the clubs in the set. There has been found to be a room for an improvement in the existing golf club set.

It is an object of the present invention to provide a golf club set having a small difference between impact timings of clubs.

A golf club set according to the present invention includes a plurality of golf clubs having different club lengths. Each of the golf clubs includes a head, a shaft, and a grip. The club length of each of the clubs is 38.5 inches or greater and 42 inches or less. Face progression is substantially constant. If a moment of inertia of the head about an axis line of the shaft is defined as MI, an MI difference ratio between the adjacent clubs is equal to or less than 3%.

Preferably, a loft angle is equal to or greater than 17 degrees in all the clubs.

Preferably, the MI difference ratio is equal to or less than 2%.

Preferably, a volume of each of the heads is 70 $cm^3$ or greater and 150 $cm^3$ or less.

Preferably, a depth of a center of gravity based on the axis line of the shaft is substantially constant in the set.

In a preferable set, the head includes a face; the face includes a thick part; the thick part includes a thick part middle point. Preferably, if a height of the thick part middle point is defined as H2, the height H2 is increased as the club length is decreased.

DESCRIPTION OF THE PREFERRED EMBODIMENTS

Hereinafter, the present invention will be described in detail based on the preferred embodiments with appropriate references to the accompanying drawings.

Figure 1:
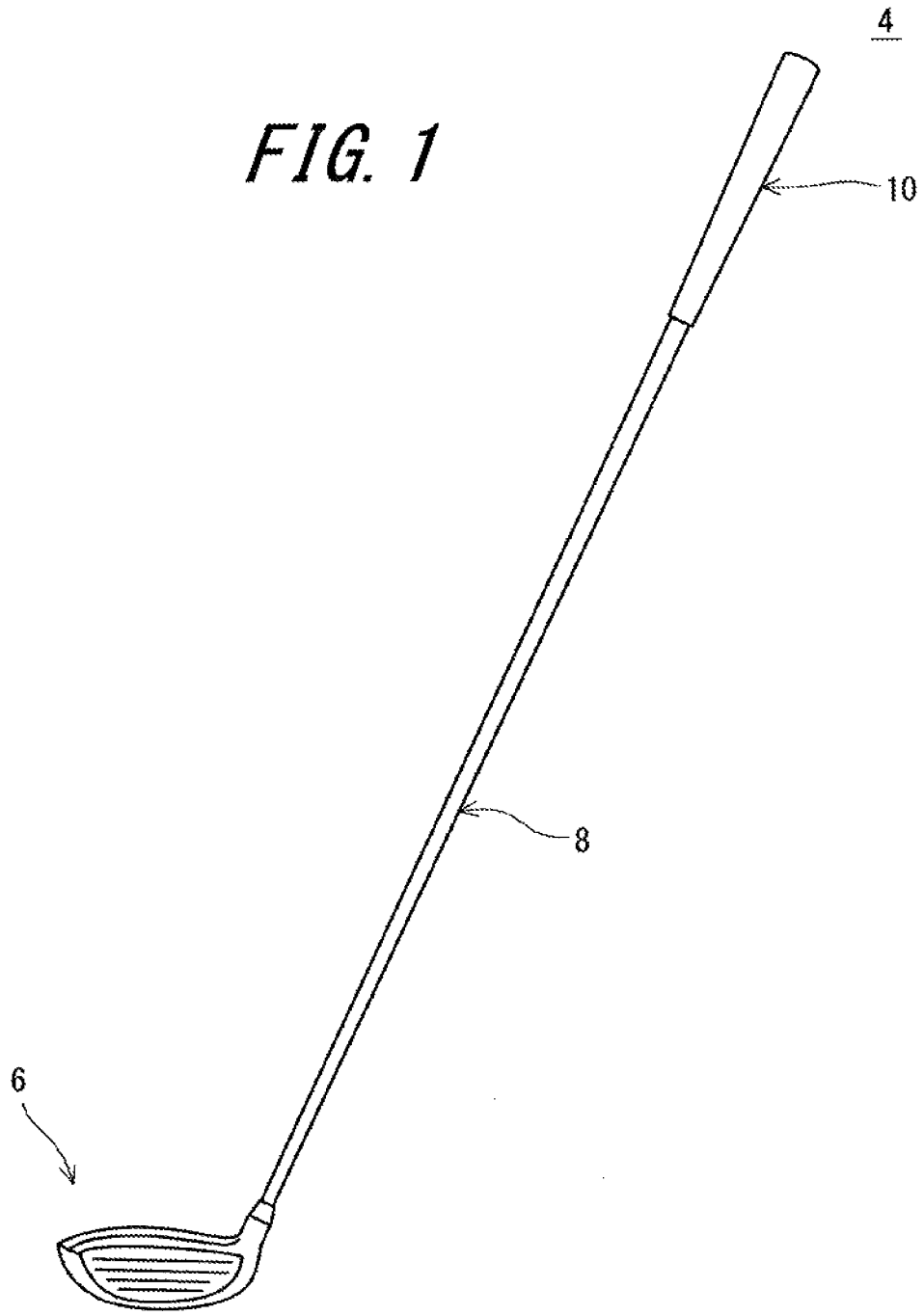
FIG. 1 shows a club according to one embodiment of the present invention.

A golf club 4 shown in FIG. 1 includes a head 6, a shaft 8, and a grip 10.

Figure 2:
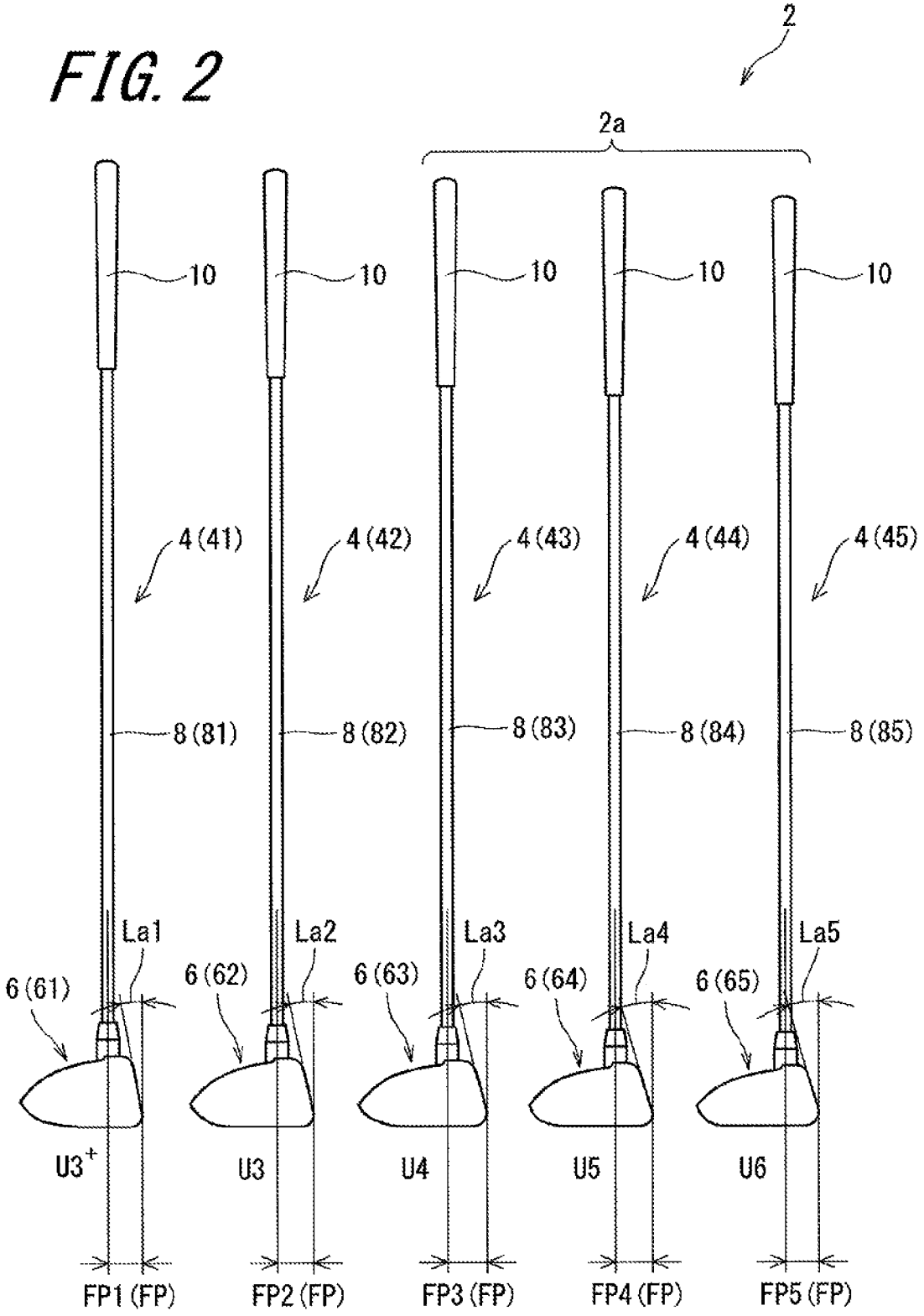
FIG. 2 shows a golf club set according to one embodiment of the present invention.

FIG. 2 shows a golf club set 2. The set 2 includes a plurality of golf clubs 4. The set 2 of the embodiment includes the five golf clubs 4. Each of the golf clubs 4 includes the head 6, the shaft 8, and the grip 10. A club length is different for each of the clubs 4. A length of the shaft 8 is different for each of the clubs 4. A loft angle of the head 6 is different for each of the clubs 4.

The number of the clubs 4 in the set 2 is equal to or greater than 2, and preferably equal to or greater than 3. In light of the restriction of the number of the clubs in the golf rules, the number of the clubs 4 in the set 2 is preferably equal to or less than 7, more preferably equal to or less than 6, and still more preferably equal to or less than 5.

In the set 2, all the heads 6 are hollow. The set 2 does not include a driver (1-wood). The set may include the driver.

As shown in FIG. 1, the head 6 has a plurality of face lines (face grooves). These face lines are omitted in the drawings other than FIG. 1.

The type of the head is not limited. For example, the head 6 may be a wood type, a utility type (hybrid type), or an iron type. In the embodiment, all the heads 6 are utility type heads.

The set 2 includes a club 41, a club 42, a club 43, a club 44, and a club 45 in ascending order of the loft angle. The loft angle of the club 41 is the minimum in the set 2. The loft angle of the club 45 is the maximum in the set 2. The loft angle means a real loft angle.

As shown in FIG. 2, the loft angle of the club 41 is shown by a double-pointed arrow La1. The loft angle of the club 42 is shown by a double-pointed arrow La2. The loft angle of the club 43 is shown by a double-pointed arrow La3. The loft angle of the club 44 is shown by a double-pointed arrow La4. The loft angle of the club 45 is shown by a double-pointed arrow La5. The loft angles La1, La2, La3, La4, and La5 are shown in ascending order. That is, La1<La2<La3<La4<La5 is set. The loft angle is increased as the club length is decreased.

For example, the loft angle La1 is 16 degrees or greater and less than 18 degrees. For example, the loft angle La2 is 18 degrees or greater and less than 20 degrees. For example, the loft angle La3 is 20 degrees or greater and less than 22 degrees. For example, the loft angle La4 is 22 degrees or greater and less than 24 degrees. For example, the loft angle La5 is 24 degrees or greater and less than 26 degrees. A preferable golf club set includes 2 or more, or 3 or more of the five loft angles.

The set 2 includes a plurality of clubs having a loft angle equal to or greater than 20 degrees. In the set 2, the clubs 43, 44, and 45 have a loft angle equal to or greater than 20 degrees. The three clubs constitute a club set 2*a* (see FIG. 2). The set 2*a* includes the clubs having a loft angle equal to or greater than 20 degrees.

In the present application, the loft angles of the N clubs which constitutes the set 2 are defined as La1, La2, . . . , LaN in descending order of the club length. However, N is a natural number equal to or greater than 2. In the embodiment, N is 5. The set 2 satisfies La1<La2< . . . <LaN.

In the embodiment, the minimum loft angle La1 in the set is preferably equal to or greater than 15 degrees, and more preferably equal to or greater than 16 degrees.

In the set 2, as the loft angle is increased, a head weight is increased. As the loft angle is increased, a head volume may be decreased.

The club 41 includes a head 61 and a shaft 81. The club 42 includes a head 62 and a shaft 82. The club 43 includes a head 63 and a shaft 83. The club 44 includes a head 64 and a shaft 84. The club 45 has a head 65 and a shaft 85.

In the set 2, as the loft angle is increased, the shaft is shortened. The shaft 81, the shaft 82, the shaft 83, the shaft 84, and the shaft 85 are set in descending order of a shaft length. In the set 2, as the loft angle is increased, the club length is decreased. The club length of the club 41 is the maximum in the set 2. The club length of the club 45 is the minimum in the set 2.

The club length is changed by 0.5 inch per club number. In the embodiment, the club length of the club 41 is 41 inches. In the set 2, the club 41 is the longest. The club length of the club 42 is 40.5 inches. The club length of the club 43 is 40 inches. The club length of the club 44 is 39.5 inches. The club length of the club 45 is 39 inches. In the set 2, the club 45 is the shortest. The club length of the longest club in the set 2 is preferably 40 inches or greater and 41.5 inches or less. The club length of the shortest club in the set 2 is preferably 38.5 inches or greater and 39.5 inches or less.

In FIG. 2, face progression FP is shown in each of the clubs 4. The face progression FP of the club 41 is shown by a double-pointed arrow FP1. The face progression FP of the club 42 is shown by a double-pointed arrow FP2. The face progression FP of the club 43 is shown by a double-pointed arrow FP3. The face progression FP of the club 44 is shown by a double-pointed arrow FP4. The face progression FP of the club 45 is shown by a double-pointed arrow FP5.

In the set 2, the face progression FP is substantially constant. The term "substantially constant" means that a difference between the maximum and minimum values of the face progression FP is equal to or less than 3 mm. The difference between the maximum and minimum values of the face progression FT is more preferably equal to or less than 2 mm, still more preferably equal to or less than 1.5 mm, and yet still more preferably equal to or less than 1 mm.

Conventionally, as the loft angle was increased, the face progression FP tended to be increased. If the loft angle was equal to or greater than 17 degrees, or equal to or greater than 20 degrees, the tendency was large. Therefore, if the loft angle is equal to or greater than 17 degrees, an effect of making the face progression FT substantially constant is increased. If the loft angle is equal to or greater than 20 degrees, the effect of making the face progression FP substantially constant is further increased.

A character showing the club number is applied to each of the heads 6. In fact, these characters are displayed on a sole s6, for example. UT3$^{+}$ is displayed on the golf club 41. UT3 is displayed on the golf club 42. UT4 is displayed on the golf club 43. UT5 is displayed on the golf club 44. UT6 is displayed on the golf club 45.

Figure 3:
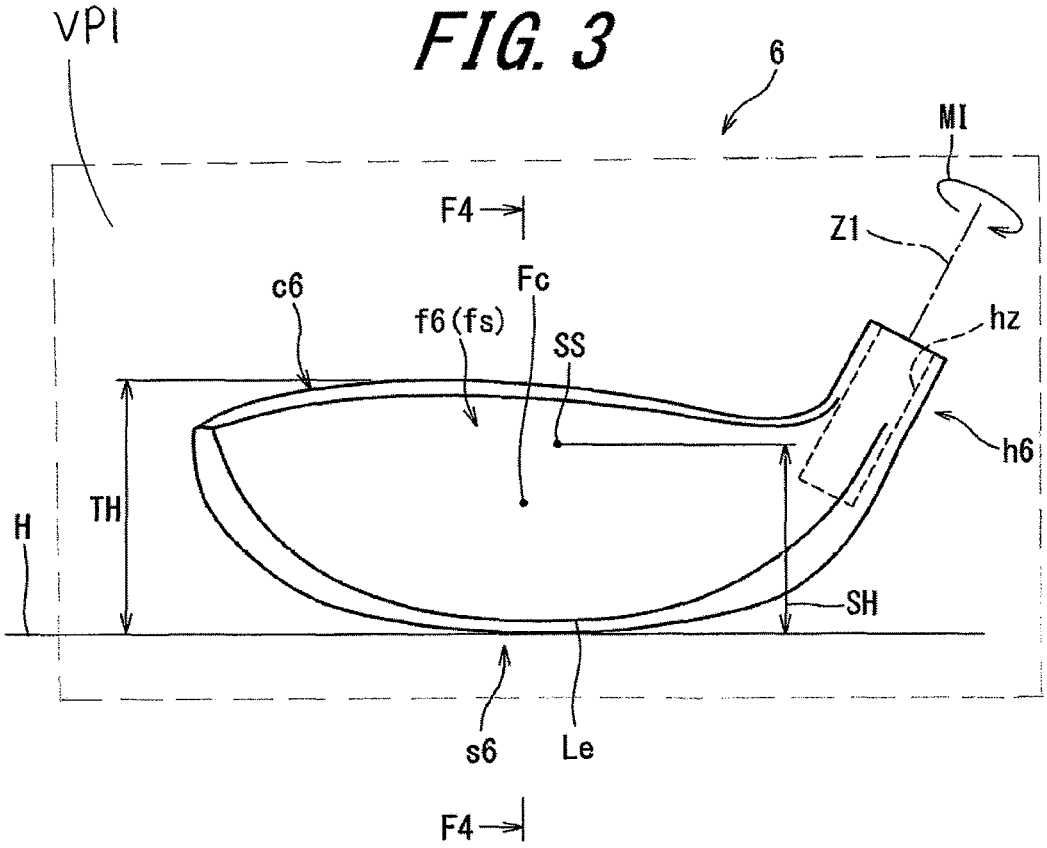
FIG. 3 is a front view of a head used for the set of FIG. 2.
Figure 4:
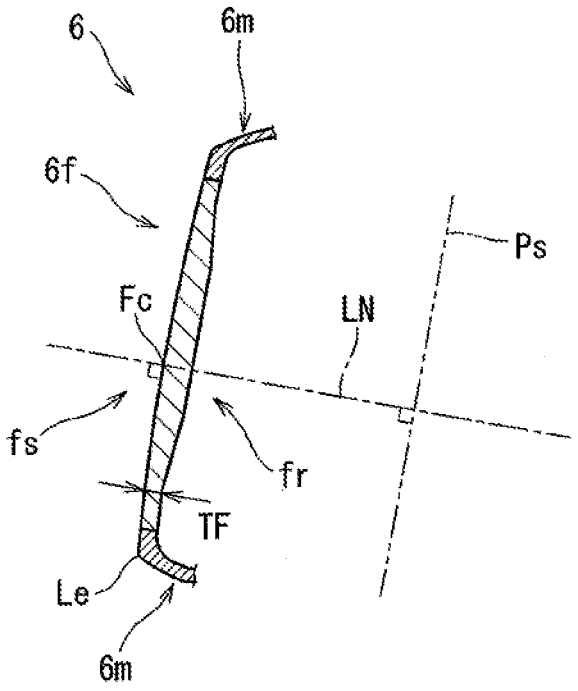
FIG. 4 is a cross-sectional view taken along line F4-F4 of FIG. 3.

FIG. 3 is a front view of the head 6. FIG. 4 is a cross-sectional view taken along line F4-F4 of FIG. 3. FIG. 4 shows only the vicinity of a face.

In the present application, matters described as the head 6 are common to all the heads 61 to 65.

The head 6 includes a face f6, a crown c6, a sole s6, and a hosel h6. The face f6 includes a face surface fs and a face back surface fr. The face surface fs is an external surface of the face f6. The face surface fs is a hitting surface. The face back surface fr is an inner surface of the face f6. The head 6 is hollow. The hosel h6 has a hosel hole hz. An axis line Z1 of the shaft coincides with the center axis line of the hosel hole hz.

In the head 6, a moment of inertia MI about the axis line Z1 of the shaft is measured. The moment of inertia MI is different for each of the heads. In the set 2, as the club length is decreased, the moment of inertia MI is increased. In the set 2, as the loft angle is increased, the moment of inertia MI is increased.

In the set 2, as the club length is decreased, the head weight is increased.

The face surface fs includes a face center Fc. The face surface fs includes a sweet spot SS. The face surface fs includes a leading edge Le. The leading edge Le is a lower edge of the face surface fs.

The face surface fs is a three-dimensional curved surface convexed to the outside. The face surface fs includes a bulge and a roll as in a general wood type head.

[Moment of Inertia MI (See FIG. 3)]

In the present application, the moment of inertia MI is a moment of inertia of the head 6. The moment of inertia MI is a moment of inertia about the axis line Z1 of the shaft. The moment of inertia MI can be measured by trade name "MOMENT OF INERTIA MEASURING INSTRUMENT MODEL NO. 005-002" manufactured by INERTIA DYNAMICS INC., for example.

[MI Difference Ratio]

In the present application, the term "MI difference ratio" is used. The MI difference ratio is a difference ratio in the moment of inertia MI between two clubs having club lengths closest to each other. Therefore, the MI difference ratio is also referred to as "an MI difference ratio between adjacent clubs". The order of the clubs is determined on the basis of the club length in order to calculate the MI difference ratio. For example, the moment of inertia MI of the club having the longest club length is defined as MI1; the moment of inertia MI of the club having the second longest club length is defined as MI2; and the moment of inertia MI of the club having the third longest club length is defined as MI3. In this case, the MI difference ratio (%) between the adjacent clubs is calculated as follows:

$$\text{MI difference ratio (1)}=100\times(\text{MI2}-\text{MI1})/\text{MI1}$$

$$\text{MI difference ratio (2)}=100\times(\text{MI3}-\text{MI2})/\text{MI2}$$

If a calculated value is minus, the absolute value of the calculated value is the MI difference ratio.

Thus, if the number of the clubs of the set is 3, the two MI difference ratios are calculated. Generally, the set including the N clubs has the (N−1) MI difference ratios.

Since the set 2 of the embodiment includes the five golf clubs 4, the four MI difference ratios are calculated. If the moment of inertia MI of the head 61 is MI1; the moment of inertia MI of the head 62 is MI2; the moment of inertia MI of the head 63 is MI3; the moment of inertia MI of the head 64 is MI4; and the moment of inertia MI of the head 65 is MI5, the following four MI difference ratios are calculated:

$$\text{MI difference ratio (1)}=100\times(\text{MI2}-\text{MI1})/\text{MI1}$$

$$\text{MI difference ratio (2)}=100\times(\text{MI3}-\text{MI2})/\text{MI2}$$

$$\text{MI difference ratio (3)}=100\times(\text{MI4}-\text{MI3})/\text{MI3}$$

$$\text{MI difference ratio (4)}=100\times(\text{MI5}-\text{MI4})/\text{MI4}$$

As described above, the set 2 includes the five clubs. The MI difference ratio of the set 2 is shown in example 1 to be described later. In the set 2, the MI difference ratio is equal to or less than 3%. That is, in the set 2, all the MI difference ratios which can be calculated are equal to or less than 3%. Rounding off can be applied to the MI difference ratio. If the MI difference ratio is equal to or less than 3.4%, "the MI difference ratio is equal to or less than 3%" is satisfied.

As described above, the set 2*a* includes the three clubs. As shown in example 2 to be described later, in the set 2*a*, the MI difference ratio is equal to or less than 1.5%.

In all the clubs in the set, the MI difference ratio is preferably equal to or less than 3%, more preferably equal to or less than 2%, and still more preferably equal to or less than 1.5%. The reason will be described later.

[MI Difference Amount]

In the present application, the term "MI difference amount" is used. The MI difference amount is a difference amount in the moment of inertia MI between two clubs having club lengths closest to each other. The MI difference amount is also a value between the adjacent clubs as in the MI difference ratio described above. The order of the clubs is determined on the basis of the club length for calculation of the MI difference amount. For example, the moment of inertia MI of the club having the longest club length is defined as MI1; the moment of inertia MI of the club having the second longest club length is defined as MI2; and the moment of inertia MI of the club having the third longest club length is defined as MI3. In this case, the MI difference amount ($g\cdot cm^2$) between the adjacent clubs is calculated as follows:

$$\text{MI difference amount (1)}=\text{MI2}-\text{MI1}$$

$$\text{MI difference amount (2)}=\text{MI3}-\text{MI2}$$

If the calculated value is minus, the absolute value of the calculated value is the MI difference amount.

Thus, if the number of the clubs of the set is 3, the two MI difference amounts are calculated. Generally, the set having the N clubs has the (N−1) MI difference amounts. For example, in example 1 to be described later, the number N of the clubs is 5, and the set has the four MI difference amounts.

In all the clubs in the set, the MI difference amount is preferably smaller. In all the clubs in the set, the MI difference amount is preferably equal to or less than 140 ($g\cdot cm^2$), more preferably equal to or less than 100 ($g\cdot cm^2$), still more preferably equal to or less than 70 ($g\cdot cm^2$), and yet still more preferably equal to or less than 50 ($g\cdot cm^2$). The reason will be described later.

In the set 2, as the club length is decreased, a distance of a center of gravity is decreased. The distance of the center of gravity is a distance (shortest distance) between the axis line Z1 of the shaft and the center of gravity of the head. In the set 2, as the club length is decreased, the head weight is increased. Meanwhile, as the club length is decreased, the distance of the center of gravity is decreased. For this reason, a countervailing effect of the head weight and the distance of the center of gravity is caused for the moment of inertia MI. The countervailing effect contributes to the suppression of the MI difference ratio.

[Base State, Base Perpendicular Plane]

A state where a center axis line Z1 of a shaft hole is included in a plane VP1 perpendicular to a level surface H and the head is placed on the level surface H at a specified lie angle and real loft angle is defined as a base state. The plane VP1 is defined as a base perpendicular plane. The specified lie angle and real loft angle are described in, for example, a product catalog. In FIG. 3, the head 6 is shown in the base state.

[Toe-Heel Direction]

A toe-heel direction is defined as a direction of an intersection line between the base perpendicular plane VP1 and the level surface H.

[Front-Back Direction]

A front-back direction is defined as a direction perpendicular to the toe-heel direction and parallel to the level surface H.

[Vertical Direction]

A vertical direction is a direction perpendicular to the level surface H.

[Face Center Fc]

A maximum width Wx of the face surface fs in the toe-heel direction is determined (abbreviated in the drawings). Furthermore, a middle position Px of the maximum width Wx in the toe-heel direction is determined. At the position Px, a middle point Py of the face surface in the vertical direction is determined. The point Py is defined as a face center Fc.

[Projection Plane Ps]

A projection plane Ps is shown by a chain double-dashed line in FIG. 4. The projection plane Ps is a plane perpendicular to a straight line LN. The straight line LN is a straight line passing through the face center Fc and being perpendicular to the face surface fs. The direction of the straight line LN is defined as a face normal direction.

[Planar View]

A projection image to the projection plane Ps is defined as a planar view. In the projection to the projection plane Ps, the direction of the projection is the face normal direction.

[Up-Down Direction]

A straight line extending in the vertical direction is projected on the projection plane Ps. The direction of the straight line projected on the projection plane Ps is defined as an up-down direction. The up-down direction is parallel to the projection plane Ps. An "upper side" and a "lower side" in the planar view are determined based on the up-down direction. The up-down direction is substantially parallel to the face surface fs.

[Head Height TH]

A head height TH is shown in FIG. 3. The head height TH is a maximum height of the crown c6. The head height TH is measured in the base state. The head height TH is a height from the level surface H. The head height TH is measured along the vertical direction.

[Sweet Spot Height SH]

In the head in the base state, the height of the sweet spot SS from the level surface H is a sweet spot height SH (see FIG. 3). The sweet spot height SH is measured along the vertical direction. The sweet spot SS is an intersection point between a perpendicular line going down to the face surface from the center of gravity of the head and the face surface fs.

[Face Progression FP]

In the head in the base state, a distance in the front-back direction between a forefront point of the head 6 and the plane VP1 is face progression FP. The forefront point of the head is a forefront point in the front-back direction.

[Head Width HW]

The maximum width of the head in the front-back direction is defined as a head width HW (see FIG. 11 to be described later).

[Depth of Center of Gravity DG]

A distance between the center of gravity of the head and the base perpendicular plane VP1 is a depth of a center of gravity DG. The depth of the center of gravity DG is measured along the front-back direction. In the present application, the depth of the center of gravity DG is also referred to as "a depth of a center of gravity based on an axis line of a shaft".

In all the clubs 4 of the set 2, the center of gravity of the head is positioned at the back of the base perpendicular plane VP1. If the center of gravity of the head is positioned at the back of the base perpendicular plane VP1, the depth of the center of gravity DG has a plus value. If the center of gravity of the head is positioned at the front of the base perpendicular plane VP1, the depth of the center of gravity DG has a minus value. In the set 2, the depth of the center of gravity DG has a plus value in all the clubs.

In the embodiment, in the set 2, the depth of the center of gravity DG is substantially constant. The term "substantially constant" means that a difference between the maximum and minimum values of the depth of the center of gravity DG is equal to or less than 3 mm. The difference between the maximum and minimum values of the depth of the center of gravity DG is more preferably equal to or less than 2.5 mm, still more preferably equal to or less than 2 mm, yet still more preferably equal to or less than 1.5 mm, and yet still more preferably equal to or less than 1 mm.

As described above, in the set 2, the face progression FP is made to be substantially constant. That is, in the set 2, as the club length is decreased, the face surface is positioned at the back in comparison with a conventional set. If the face surface moves to the back, the center of gravity of the head is also apt to move to the back. In the embodiment, as the club length is decreased, a mass rate M1 of a sole front middle part is increased. In the embodiment, as the club length is decreased, the average thickness of the sole front middle part is increased. For this reason, in the set 2, variation in the position of the center of gravity of the head based on the mass distribution of the sole s6, and variation in the position of the center of gravity of the head based on the face progression FP are countervailed. For this reason, the depth of the center of gravity DG is made to be substantially constant. In this case, an impact timing effect (to be described later) can be improved. The mass rate M1 is a value obtained by dividing the mass of the sole front middle part by the mass of the head 6.

The sole front middle part is a part of the sole s6, and is a range satisfying the following items (a), (b), and (c):

(a) a range positioned in the front of a position separated by 20 mm from the forefront point of the head 6 in the front-back direction;

(b) a range positioned in the back of a position separated by 11 mm from the leading edge Le in the front-back direction; and (c) a range in which a distance from the face center Fc in the toe-heel direction is equal to or less than 25 mm.

The item (a) defines a back boundary line Lb of the sole front middle part. The item (b) defines a front boundary line Lf of the sole front middle part. The item (c) defines a toe side boundary line Lt and a heel side boundary line Lh of the sole front middle part. Although not illustrated in the drawings, in the planar view of the sole s6, the boundary line Lb is a straight line along the toe-heel direction; the boundary line Lf is a curve line along the leading edge Le; and the boundary lines Lt and Lh are straight lines along the front-back direction. The sole front middle part is a range surrounded by the boundary lines Lb, Lf, Lt, and Lh.

A change in the head width HW is suppressed in the set 2. The constitution contributes to the substantially constant depth of the center of gravity DG. In this respect, an amount of change in the head width HW in the set is preferably equal to or less than 2 mm, more preferably equal to or less than 1 mm, and still more preferably equal to or less than 0.5 mm. The amount of change is a difference between the maximum and minimum values of the head width HW in the set. The amount of change may be 0 mm.

In respect of preventing a too low ball trajectory, the depth of the center of gravity DG is preferably equal to or greater than 5 mm, more preferably equal to or greater than 6 mm, and still more preferably equal to or greater than 7 mm. In respect of suppressing side spin by a gear effect, the depth of the center of gravity DG is preferably equal to or less than 18 mm, more preferably equal to or less than 16 mm, still more preferably equal to or less than 14 mm, and yet still more preferably equal to or less than 12 mm. Preferably, in all the clubs in the set, the depth of the center of gravity DG is set to the preferable value.

[Periphery of Face Surface fs]

If the periphery of the face surface can be visually specified by a clear ridge line or the like, the face surface is defined as a range surrounded by the periphery. If the periphery is not clarified by roundness or the like, a large number of planes including a straight line L1 (not shown) connecting the center of gravity of the head to the sweet spot SS are assumed. In each of the sections along these planes, a curvature radius r of the external surface of the head is measured. The curvature radius r is continuously measured toward the outer direction from the face center Fc. In the continuous measurement, a point where the curvature radius r is first set to be equal to or less than 200 mm is defined as the periphery. In the measurement of the curvature radius r, a face line and a punch mark or the like are assumed to be absent.

Figure 5:
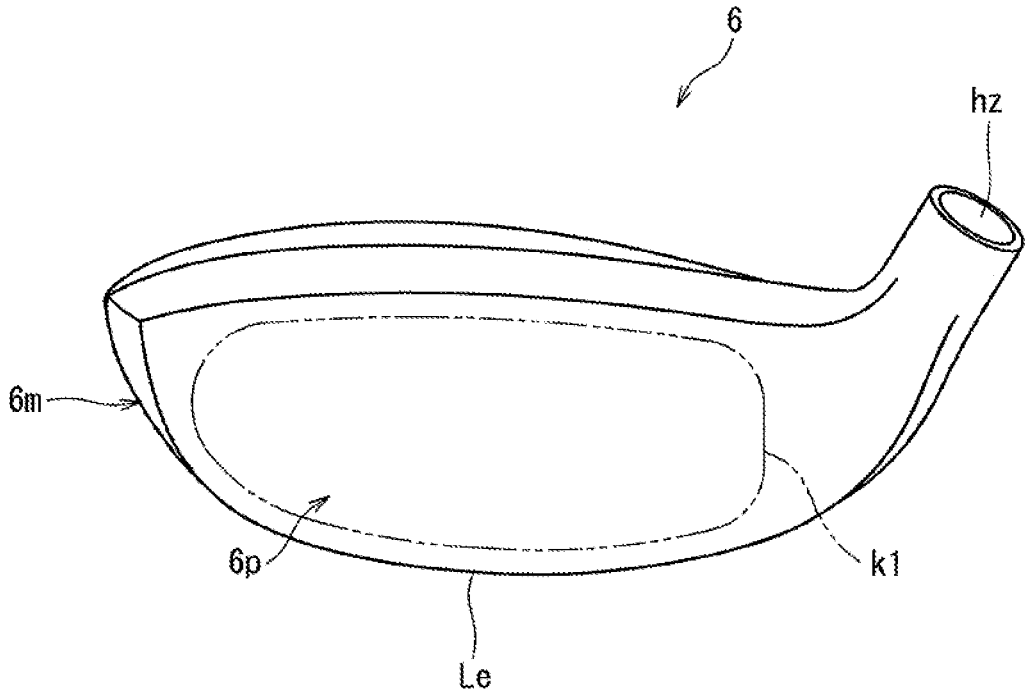
FIG. 5 is a perspective view of the head of FIG. 3.
Figure 6:
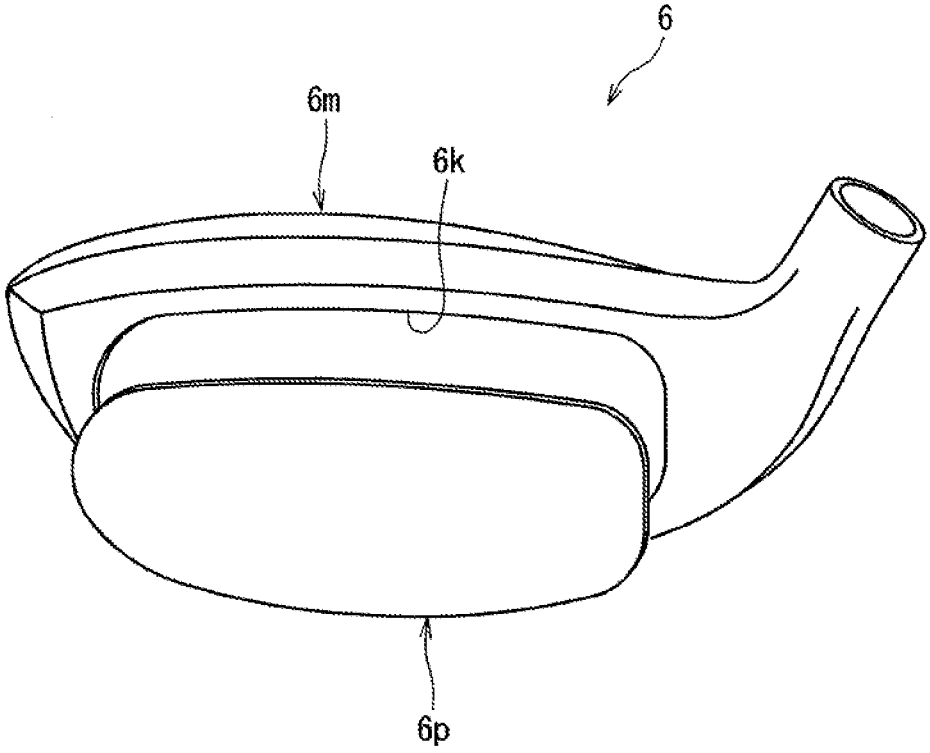
FIG. 6 is an exploded perspective view of the head of FIG. 3.

FIG. 5 is a perspective view of the head 6. FIG. 6 is an exploded perspective view of the head 6. As shown in FIG. 6, the head 6 is formed by joining a face member 6*p* to a head body 6*m*. The joining is achieved by welding. The head body 6*m* has an opening 6*k*. The shape of the opening 6*k* corresponds to the contour shape of the face member 6*p*. The opening 6*k* is blocked by the face member 6*p*. A boundary k1 between the head body 6*m* and the face member 6*p* is shown by a chain double-dashed line in FIG. 5.

A rate Rp of an area formed by the face member 6*p* to the whole area of the face surface fs is preferably equal to or greater than 60%, more preferably equal to or greater than 70%, and still more preferably equal to or greater than 80%. If the face member 6*p* is formed from a plate material, the face member 6*p* may be plate-like. Therefore, the peripheral part of the face surface fs may be formed by the head body 6*m*. In this respect, the rate Rp is preferably equal to or less than 95%, and more preferably equal to or less than 90%.

The face member 6*p* is plate-like. The face member 6*p* forms a part of the face f6. The face member 6*p* forms a middle portion of the face f6. The head body 6*m* forms a surrounding portion of the face f6. The head body 6*m* forms the face f6 around the face member 6*p*. The face member 6*p* is allowed to be plate-like due to the constitution.

The material of the face member 6*p* is different from the material of the head body 6*m*.

A particularly high strength is required for the face. For this reason, a material having a strength higher than the strength of the head body is preferably used for the face. In this case, a cup-like (dish-like) face member is considered to be used. The face progression FP may be changed by the width of a welded portion in the cup-like face member. Meanwhile, in the embodiment, the head body 6*m* forms the surrounding portion of the face f6. For this reason, even if the width of the welded portion is changed, the face progression FP is not changed. Therefore, the error of the face progression FP is less likely to be caused.

The material of the head body 6*m* is not limited. Examples of the material of the head body 6*m* include a metal and CFRP (carbon fiber reinforced plastic). Examples of the metal include one or more kinds of metals selected from pure titanium, a titanium alloy, stainless steel, maraging steel, an aluminum alloy, a magnesium alloy, and a tungsten-nickel alloy. Examples of the stainless steel include SUS630 and SUS304. Specific examples of the stainless steel include CUSTOM450 (manufactured by Carpenter Technology Corporation). Examples of the titanium alloy include 6-4 titanium (Ti-6Al-4V), and Ti-15V-3Cr-3Sn-3Al.

The material of the face member 6*p* is not limited. In respect of a strength, the material is preferably the titanium alloy and the maraging steel, and more preferably the maraging steel. Preferable examples of the maraging steel include Custom455 and HT1770. The material of the face member 6*p* in the embodiment is Custom455.

The head body 6*m* is produced by casting. Meanwhile, the face member 6*p* is produced by press processing a plate material. The plate material is a flat plate. The plate material is a rolled material. The rolled material has few defects, and has an excellent strength. Furthermore, the rolled material has high thickness precision. The thickness precision of the face f6 is enhanced by using the rolled material. The strength of the face f6 is enhanced by using the rolled material.

Other preferable material of the rolled material is a forged material. The forged material also has few defects, and has an excellent strength. In respect of a strength, the material of the face member 6*p* is preferably the rolled material or the forged material, and more preferably the rolled material.

As described above, the face surface fs is a three-dimensional curved surface including a bulge and a roll. For this reason, if the flat plate is used as the material, the flat plate is bent.

The face back surface fr of the face member 6*p* is formed by NC processing. A thickness TF is formed with high precision by the NC processing. NC stands for "Numerical Control". In more detail, the face back surface fr is formed by CNC processing. CNC stands for "Computerized Numerical Control". The precision of the thickness TF is high.

The producing process of the face member 6*p* includes the following steps A, B, and C:

(1) a step A of subjecting the flat plate to NC processing;

(2) a step B of cutting the flat plate into the contour shape of the face member 6*p*; and (3) a step C of bending the member subjected to the step A and the step B.

The step B is preferably performed by the NC processing. Furthermore, NC data of the step A and NC data of the step B are preferably correlated with each other. In this case, the distribution of the thickness TF can be formed with high precision.

The step C (bending) is performed by a press. The press is a cold press. The cold press is less likely to cause a change in the thickness TF formed by the NC processing during the press. Therefore, the precision of the thickness TF is enhanced.

Thus, the face member 6*p* is produced by subjecting the flat plate to the NC processing, and thereafter bending the flat plate. The precision of the thickness TF is enhanced by subjecting the flat plate to the NC processing. If the NC processing is performed after bending, the error of the bending is not reflected in the NC data, and the precision the thickness TF may be decreased as a result.

Furthermore, the flat plate is the rolled material. The thickness distribution can be formed with high precision by subjecting the rolled material having excellent thickness precision to the NC processing.

Figure 7:
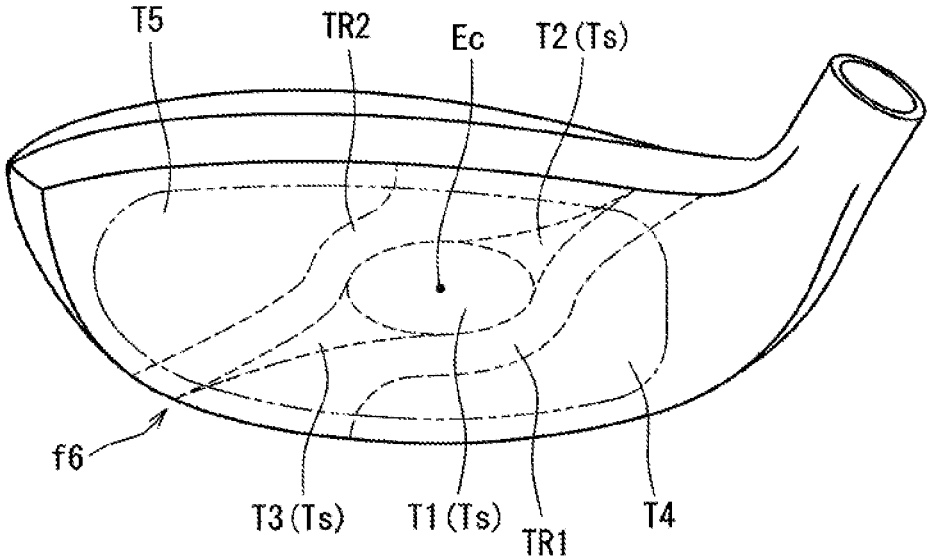
FIG. 7 is the same perspective view as FIG. 5, and a ridge line formed on a back surface of a face is shown by a dashed line in FIG. 7.

FIG. 7 describes the thickness distribution of the face f6. A ridge line formed on the face back surface fr is shown by a dashed line in FIG. 7. The face back surface fr is continuous with no step as a whole. However, a large number of fine lines are formed on the face back surface fr (abbreviated in the drawings). These lines are milling marks.

The face f6 includes a first thick part T1. In the embodiment, the first thick part T1 is an elliptical range. The thick part T1 includes the face center Fc. Furthermore, the face f6 includes a second thick part T2 and a third thick part T3. The second thick part T2 is thinner than the first thick part T1. The third thick part T3 is thinner than the first thick part T1.

In the present application, the first thick part T1 is also merely referred to as a thick part. In the present application, the second thick part T2 and the third thick part T3 are also merely referred to as sub-thick parts.

The face f6 includes an inclination thick part Ts. The inclination thick part Ts is formed by the thick part T1 and the sub-thick parts T2 and T3. The inclination thick part Ts extends toward a toe lower side from a heel upper side.

The sub-thick parts T2 and T3 thinner than the thick part T1 can suppress the range of the thick part T1 and improve rebound performance. Furthermore, a face strength is enhanced by the sub-thick parts T2 and T3 extending in a rib form.

The second thick part T2 is adjacent to the thick part T1. The second thick part T2 extends toward a heel side and an upper side from the thick part T1. In the embodiment, the width of the second thick part T2 is smaller as going to the heel side. The second thick part T2 has an acuate tip. The third thick part T3 is adjacent to the thick part T1. The third thick part T3 extends toward a toe side and a lower side from the thick part T1. In the embodiment, the width of the third thick part T3 is smaller as going to the toe side. The third thick part T3 has an acuate tip.

The face f6 includes a thin part. The thin part includes a heel thin part T4 and a toe thin part T5. The heel thin part T4 is thinner than the thick part T1. The heel thin part T4 is thinner than the second thick part T2 (sub-thick part). The heel thin part T4 is thinner than the third thick part T3 (sub-thick part). The toe thin part T5 is thinner than the thick part T1 . The toe thin part T5 is thinner than the second thick part T2 (sub-thick part). The toe thin part T5 is thinner than the third thick part T3 (sub-thick part).

The heel thin part T4 is thinner than the inclination thick part Ts. The heel thin part T4 is an example of the thin part. The toe thin part T5 is thinner than the inclination thick part Ts. The toe thin part T5 is an example of the thin part.

As shown in FIG. 7, the inclination thick part Ts crosses the face member 6*p*. The inclination thick part Ts contributes to an improvement in the face strength while allowing the thin parts T4 and T5 to be present.

The face f6 includes a transitional part. The transitional part is positioned between the inclination thick part Ts and the thin parts T4 and T5. The transitional part connects the inclination thick part Ts to the thin parts T4 and T5 with no step. In the embodiment, the transitional part includes a first transitional part TR1 and a second transitional part TR2. The first transitional part TR1 is positioned between the inclination thick part Ts and the heel thin part T4. The first transitional part TR1 is adjacent to the heel thin part T4. The first transitional part TR1 is adjacent to the thick part T1. The first transitional part TR1 is adjacent to the inclination thick part Ts. The second transitional part TR2 is positioned between the inclination thick part Ts and the toe thin part T5. The second transitional part TR2 is adjacent to the toe thin part T5. The second transitional part TR2 is adjacent to the thick part T1 . The second transitional part TR2 is adjacent to the inclination thick part Ts.

The first transitional part TR1 extends toward the toe lower side from the heel upper side. The thickness of the first transitional part TR1 is between the thickness of the inclination thick part Ts and the thickness of the heel thin part T4. The thickness of the first transitional part TR1 is thinner as going to the heel thin part T4 from the inclination thick part Ts.

The second transitional part TR2 extends toward the toe lower side from the heel upper side. The thickness of the second transitional part TR2 is between the thickness of the inclination thick part Ts and the thickness of the toe thin part T5. The thickness of the second transitional part TR2 is thinner as going to the toe thin part T5 from the inclination thick part Ts.

The heel thin part T4 is thinner than the transitional parts TR1 and TR2. The toe thin part T5 is thinner than the transitional parts TR1 and TR2.

The thickness TF of the first thick part T1 is the maximum in the face member 6*p*. The thickness TF of the first thick part T1 is the maximum in the face f6. However, a portion in which a difference between the maximum thickness and the thickness of the portion is equal to or less than 0.02 mm is also regarded as the thick part T1.

As shown in FIG. 7, the face member 6*p* includes the whole thick part T1. The face member 6*p* includes at least a part of the sub-thick parts T2 and T3. The face member 6*p* includes at least a part of the heel thin part T4. The face member 6*p* includes at least a part of the toe thin part T5. The face member 6*p* includes at least a part of the first transitional part TR1. The face member 6*p* includes at least a part of the second transitional part TR2.

In the embodiment, the thickness TF of each portion is as follows:

first thick part T1: 2.15 mm second thick part T2: 1.7 mm or greater and less than 2.15 mm third thick part T3: 1.6 mm or greater and less than 2.15 mm heel thin part T4: 1.5 mm toe thin part T5: 1.6 mm In the embodiment, the difference in the thickness between the thick part T1 and the sub-thick parts T2 and T3 is equal to or less than 0.55 mm.

In respect of the face strength, the thickness of the first thick part T1 is preferably equal to or greater than 1.9 mm, and more preferably equal to or greater than 2.0 mm. In respect of the rebound performance, the thickness of the first thick part T1 is preferably equal to or less than 2.4 mm, and more preferably equal to or less than 2.3 mm.

In respect of the face strength, the average thickness of the sub-thick parts T2 and T3 is preferably equal to or greater than 1.5 mm, and more preferably equal to or greater than 1.6 mm. In respect of the rebound performance, the average thickness of the sub-thick parts T2 and T3 is preferably equal to or less than 2.2 mm, and more preferably equal to or less than 2.1 mm.

In respect of the face strength, the average thickness of the thin parts T4 and T5 is preferably equal to or greater than 1.3 mm, and more preferably equal to or greater than 1.4 mm. In respect of the rebound performance, the average thickness of the thin parts T4 and T5 is preferably equal to or less than 1.8 mm, and more preferably equal to or less than 1.7 mm.

A thick part middle point Ec is shown in FIG. 7. In the planar view, the center of figure of the thick part T1 can be determined. The center of figure in the planar view is the thick part middle point Ec. In the embodiment, the center of an ellipse which is an outline of the thick part T1 is the thick part middle point Ec.

Figure 8:
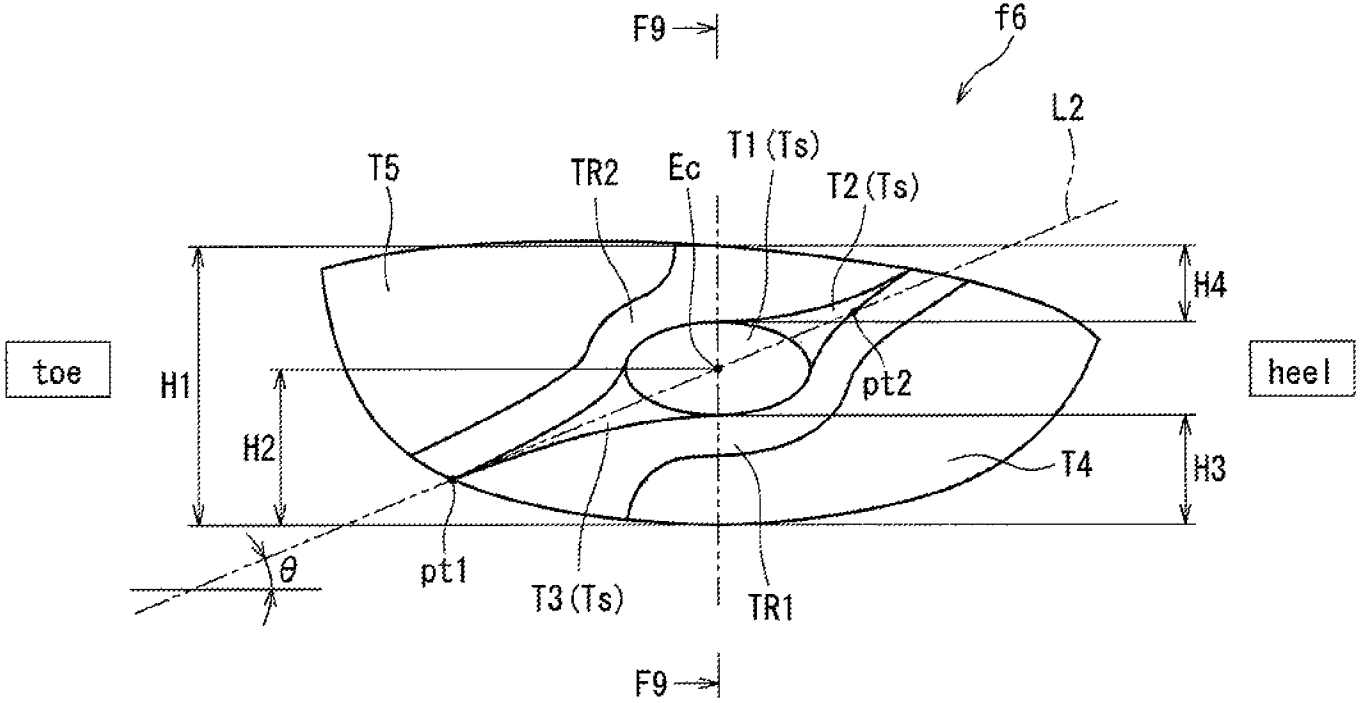
FIG. 8 is a planar view showing the thickness distribution of the face.
Figure 9:
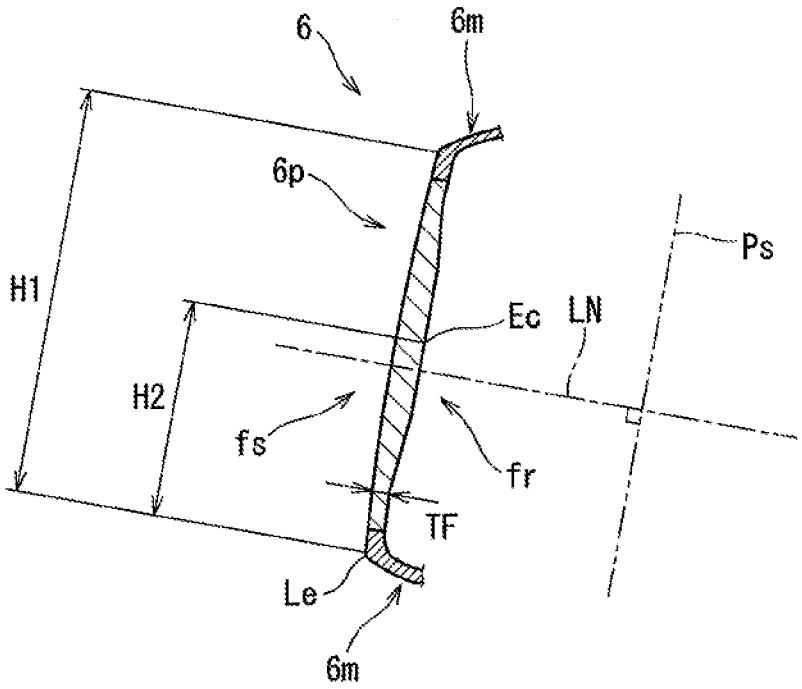
FIG. 9 is a cross-sectional view taken along line F9-F9 of FIG. 8.

FIG. 8 shows the face f6 in the planar view. FIG. 9 is a cross-sectional view of the head 6 taken along a sectional line F9-F9 of FIG. 8. The sectional line F9-F9 passes through the thick part middle point Ec.

Boundary lines shown by solid lines in FIG. 8 are ridge lines visually recognized on the face back surface fr. These boundary lines are not visually recognized from the face surface fs side. Therefore, the boundary lines shown by the solid lines in FIG. 8 should be essentially shown by dashed lines. In FIG. 8, in order to clarify the boundary lines, the boundary lines which should be the dashed lines are shown by the solid lines. The plan view of the actual face back surface fr is obtained by horizontally inverting FIG. 8.

A face height at a position (a position in a toe-heel direction) of the thick part middle point Ec is shown by a double-pointed arrow H1 in FIGS. 8 and 9. The height H1 is measured in the planar view. The height H1 is measured along the up-down direction described above. The starting point of the height H1 is a lower edge of the face surface fs. The lower edge is the leading edge Le. The end point of the height H1 is an upper edge of the face surface fs.

A height of the thick part middle point Ec is shown by a double-pointed arrow H2 in FIGS. 8 and 9. The height H2 is also measured at a position (a position in the toe-heel direction) of the thick part middle point Ec. The height H2 is measured in the planar view. The height H2 is measured along the up-down direction described above. The starting point of the height H2 is the lower edge of the face surface fs. The end point of the height H2 is the thick part middle point Ec.

As shown in FIG. 8, the inclination thick part Ts extends toward the toe lower side from the heel upper side. The inclination thick part Ts extending toward the toe lower side from the heel upper side is formed by the thick part T1 and the sub-thickness parts T2 and T3.

The inclination thick part Ts extends toward the toe lower side from the heel upper side, and thereby the thin parts T4 and T5 are likely to be secured at a heel lower side and a toe upper side. As a result of analyzing many golf players' hitting points, ordinary golf players' hitting points have been distributed in relatively large numbers at the heel lower side and the toe upper side. The thin parts T4 and T5 at the heel lower side and the toe upper side can contribute to an improvement in an average flight distance.

[Face Height H1]

If a ball directly placed on a lawn is hit, an excessively large height H1 is not preferable. In light of the point, the height H1 is preferably equal to or less than 40 mm, more preferably equal to or less than 38 mm, and still more preferably equal to or less than 36 mm. A thin range other than the thick part T1 can improve the rebound performance. In this respect, the height H1 is preferably equal to or greater than 29 mm, more preferably equal to or greater than 30 mm, still more preferably equal to or greater than 31 mm, and yet still more preferably equal to or greater than 32 mm. A preferable range of the height H1 described above is preferably satisfied in all the clubs included in the club set.

In the set 2, as the club length is decreased, the height H1 is increased. In this case, as the club length is decreased, the face progression FP is likely to be increased. However, contrary to the tendency, the face progression FP is made to be substantially constant in the set 2. That is, in respect of the impact timing effect, a constitution contrary to the conventional tendency is employed.

[Height H2 of Thick Part Middle Point]

If the ball directly placed on the lawn is hit, the hitting point is apt to be positioned at a low side. The height H2 is increased, and thereby the rebound performance can be improved if the hitting point is positioned at the low side. In this respect, the height H2 is preferably equal to or greater than 16 mm, more preferably equal to or greater than 17 mm, and still more preferably equal to or greater than 18 mm. If the height H2 is excessively large, the strength of the face may be decreased. In this respect, the height H2 is preferably equal to or less than 22 mm, more preferably equal to or less than 21 mm, and still more preferably equal to or less than 20 mm. A preferable range of the height H2 described above is preferably satisfied in all the clubs included in the club set.

In the set 2, as the club length is decreased, the height H2 is increased. In this case, as the club length is decreased, the thick part T1 is likely to move to the back. This is because the head 6 has the loft angle. The thick part T1 is likely to move to the back, and thereby the depth of the center of gravity DG is likely to be changed. However, in the set 2, as the club length is decreased, the head width HW is decreased. The substantially constant depth of the center of gravity DG is likely to be achieved by the countervailing between the back movement of the thick part T1 and the change in the head width HW.

[H2/H1]

In respect of the rebound performance if the hitting point is positioned at the lower side, a ratio H2/H1 is preferably equal to or greater than 0.55, and more preferably equal to or greater than 0.56. In light of the strength of the face, the ratio H2/H1 is preferably equal to or less than 0.63, and more preferably equal to or less than 0.60. A preferable range of the ratio H2/H1 described above is preferably satisfied in all the clubs included in the club set.

The lowering of the sweet spot height SH was conventionally considered to contribute to the flight distance. If the height H2 of the thick part middle point is increased, the sweet spot height SH is apt to be increased. For this reason, the height H2 of the thick part middle point was not conventionally increased. Conventionally, the ratio H2/H1 was decreased.

[Face Height H3 Lower Than Thick Part]

A face height lower than the thick part T1 is shown by a double-pointed arrow H3 in FIG. 8. The height H3 is also a face height lower than the inclination thick part Ts. The height H3 is measured at the position of the thick part middle point Ec in the toe-heel direction. The height H3 is measured in the planar view described above. The height H3 is measured in the up-down direction described above.

In respect of the rebound performance when the hitting point is positioned at the lower side, the height H3 is preferably equal to or greater than 7 mm, more preferably equal to or greater than 9 mm, and still more preferably equal to or greater than 11 mm. In respect of the strength of the face, the height H3 is preferably equal to or less than 19 mm, more preferably equal to or less than 17 mm, and still more preferably equal to or less than 15 mm. A preferable range of the height H3 described above is preferably satisfied in all the clubs included in the club set.

[Face Height H4 Upper than Thick Part]

A face height upper than the thick part T1 is shown by a double-pointed arrow H4 in FIG. 8. The height H4 is also a face height upper than the inclination thick part Ts. The height H4 is measured at the position of the thick part middle point Ec in the toe-heel direction. The height H4 is measured in the planar view described above. The height H4 is measured along the up-down direction described above.

[H3/H4]

In respect of securing the rebound performance when the hitting point is positioned at the lower side, a ratio H3/H4 is preferably equal to or greater than 1.0, more preferably equal to or greater than 1.1, and still more preferably equal to or greater than 1.2. In respect of enhancing the face strength, the ratio H3/H4 is preferably equal to or less than 1.8, more preferably equal to or less than 1.7, and still more preferably equal to or less than 1.6. A preferable range of the ratio H3/H4 described above is preferably satisfied in all the clubs included in the club set.

[H2−H3]

In respect of enhancing the face strength, a difference (H2−H3) is preferably equal to or greater than 2 mm, more preferably equal to or greater than 3 mm, and still more preferably equal to or greater than 4 mm. In respect of enhancing the rebound performance, the difference (H2−H3) is preferably equal to or less than 9 mm, more preferably equal to or less than 8 mm, and still more preferably equal to or less than 7 mm. A preferable range of the difference (H2−H3) described above is preferably satisfied in all the clubs included in the club set.

[Distance between Thick Part Middle Point Ec and Face Center Fc in Toe-Heel Direction]

In respect of the face strength, the position of the thick part middle point Ec in the toe-heel direction is preferably close to the face center Fc. In this respect, a distance between the point Ec and the face center Fc in the toe-heel direction is preferably equal to or less than 5 mm, more preferably equal to or less than 4 mm, and still more preferably equal to or less than 3 mm. The distance may be 0. The preferable distance is preferably satisfied in all the clubs included in the club set.

[Area Rate Ra of Thick Part]

An area rate Ra is a rate of an area of the thick part T1 to an area of the whole face surface. In respect of the face strength, the area rate Ra is preferably equal to or greater than 5%, and more preferably equal to or greater than 7%. In respect of the rebound performance, the area rate Ra is preferably equal to or less than 20%, and more preferably equal to or less than 18%. The area rate Ra is calculated in the planar view described above.

[Inclination Angle θ]

A longest cross line of the inclination thick part Ts is shown by a straight line L2 in FIG. 8. The longest cross line L2 is defined in the planar view described above. The longest cross line L2 is a straight line passing through the thick part middle point Ec and having a longest cross length. Two intersection points pt1 and pt2 may be present between the outline of the inclination thick part Ts and the straight line (see FIG. 8). A distance between the two intersection points pt1 and pt2 is the cross length. In the planar view, an angle between a horizontal direction and the straight line L2 is defined as an inclination angle θ. The horizontal direction is a direction of a straight line obtained by projecting a straight line along the toe-heel direction on the projection plane Ps.

In the set 2, as the club length is decreased, the inclination angle θ of the inclination thick part Ts is increased. Flight distance performance can be improved as the whole set by the constitution. As the club length is decreased, a hitting point distribution is changed. As described above, the inclination angle θ is changed, and thereby the disposal of the thin part is likely to comply with the hitting point distribution. Therefore, the flight distance can be increased.

An intermediate head between a wood type head and an iron type head is generally referred to as a utility type head. The utility type head may be referred to as a hybrid type head. A typical utility type head is hollow. Generally, the utility type head has the advantages of the wood type head and the iron type head. Therefore, the specification of the head is preferably an intermediate specification between the specifications of the wood type head and the iron type head.

In the respect described above, the lower limit of the head volume is preferably equal to or greater than 70 $cm^3$, more preferably equal to or greater than 80 $cm^3$, and still more preferably equal to or greater than 90 $cm^3$. The upper limit of the head volume is preferably equal to or less than 150 $cm^3$, more preferably equal to or less than 140 $cm^3$, and still more preferably equal to or less than 130 $cm^3$. The lower limit of the real loft angle is preferably equal to or greater than 15 degrees, more preferably equal to or greater than 16 degrees, and still more preferably equal to or greater than 17 degrees. The upper limit of the real loft angle is preferably equal to or less than 32 degrees, more preferably equal to or less than 30 degrees, still more preferably equal to or less than 28 degrees, and yet still more preferably equal to or less than 26 degrees. The lower limit of the head width HW (see FIG. 11) is preferably equal to or greater than 45 mm, more preferably equal to or greater than 50 mm, and still more preferably equal to or greater than 55 mm. The upper limit of the head width HW is preferably equal to or less than 120 mm, more preferably equal to or less than 100 mm, still more preferably equal to or less than 90 mm, and yet still more preferably equal to or less than 80 mm. The head width HW is the maximum width in the front-back direction of the head. The lower limit of the head height TH (see FIG. 3) is preferably equal to or greater than 30 mm, more preferably equal to or greater than 32 mm, and still more preferably equal to or greater than 34 mm. The upper limit of the head height TH is preferably equal to or less than 42 mm, more preferably equal to or less than 40 mm, and still more preferably equal to or less than 37 mm.

In respect of suppressing the MI difference ratio, the amount of change in the head volume in the set is preferably decreased. The amount of change in the head volume in the set is preferably equal to or less than 15 $cm^3$, more preferably equal to or less than 12 $cm^3$, and still more preferably equal to or less than 10 $cm^3$. The amount of change is a difference between the maximum and minimum values of the head volume.

A club having the utility type head is referred to as a utility type club. The club has the advantages of the wood type club and the iron type club. In this respect, the lower limit of the club length is preferably equal to or greater than 38.5 inches, and more preferably equal to or greater than 39 inches. The upper limit of the club length is preferably equal to or less than 42 inches, more preferably equal to or less than 41.5 inches, still more preferably equal to or less than 41.25 inches, and yet still more preferably equal to or less than 41 inches.

The club length is measured based on the golf rule of "1c. Length" in "1. Clubs" of "Appendix II. Design of Clubs" specified by R&A (Royal and Ancient Golf Club of Saint Andrews).

[Effect Based on Face Progression FP]

The face progression FP is made to be substantially constant, and thereby the position of the face surface to the axis line of the shaft in the front-back direction is made to be substantially constant. Therefore, impact timings between the clubs are likely to coincide with each other. For this reason, the variation in hit ball directivity between the clubs is suppressed, and the directional stability of a hit ball can be improved as the whole set. In the present application, the effect is also referred to as the impact timing effect.

[Effect Based on MI Difference Ratio]

The moment of inertia MI about the axis line Z1 of the shaft has an effect on the return of the head (the rotation of the head) during swing. If the moment of inertia MI is largely changed, the variation in the return of the head is caused. For this reason, the variation in the hit ball directivity is apt to be caused between the clubs. The variation in the return of the head is less likely to be caused by suppressing the MI difference ratio. Therefore, the directional stability of the hit ball can be improved as the whole set.

The effect based on the MI difference amount is similar to the effect based on the MI difference ratio.

[Effect Based on Depth of Center of Gravity DG]

Usually, the center of gravity of the head is positioned at the back of the axis line Z1 of the shaft. Also in the embodiment, in all the clubs in the set, the center of gravity of the head is positioned at the back of the axis line Z1 of the shaft. In impact, the flexure of the shaft is likely to be caused so that the center of gravity of the head is positioned on an extended line of the axis line Z1 of the shaft. Herein, the axis line Z1 of the shaft is an axis line of a portion which is not flexed.

Figure 10:
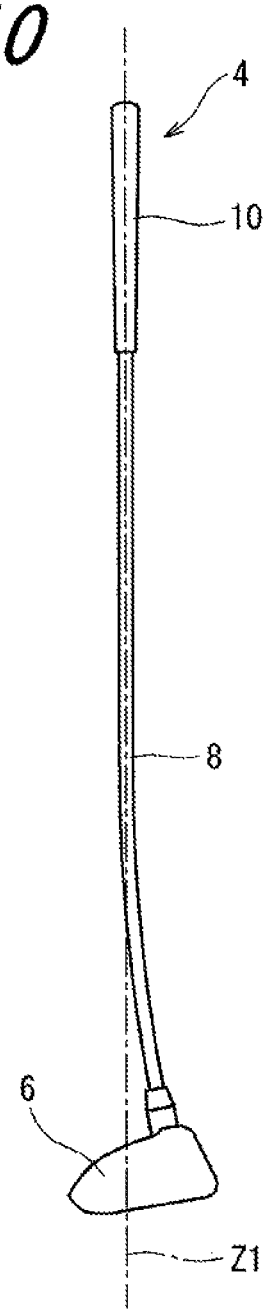
FIG. 10 shows the flexure of a shaft caused by a position of a center of gravity of the head.

The flexure is caused based on a centrifugal force acting on the center of gravity of the head. As shown in FIG. 10, the flexure of the shaft is flexure in which the head precedes in a swing direction. As the depth of the center of gravity DG is increased, the flexure is likely to be increased.

The flexure may make the impact timing different. The depth of the center of gravity DG based on the axis line of the shaft is made to be substantially constant, and thereby the amount of the flexure is also likely to be constant. Therefore, the impact timings are likely to coincide with each other between the clubs. The impact timing effect is further enhanced by making the depth of the center of gravity DG substantially constant. Therefore, the directional stability of the hit ball can be improved as the whole set.

As described above, if the impact timings are different, the hit ball directivity is apt to be deteriorated. In order to resolve the problem, the golf player may change the swing for each club. However, it is difficult to perform different swing for each club to make the swing comply with each club. The change of the swing may confuse the golf player. Particularly, the golf player in a round is apt be confused. If the golf player is mentally confused, the swing is apt to be in disorder. If the swing is in disorder, the variation in a shot is increased. The variation in the shot deteriorates a score. The impact timing effect described above can contribute also to mental stability and swing stability.

Figure 11:
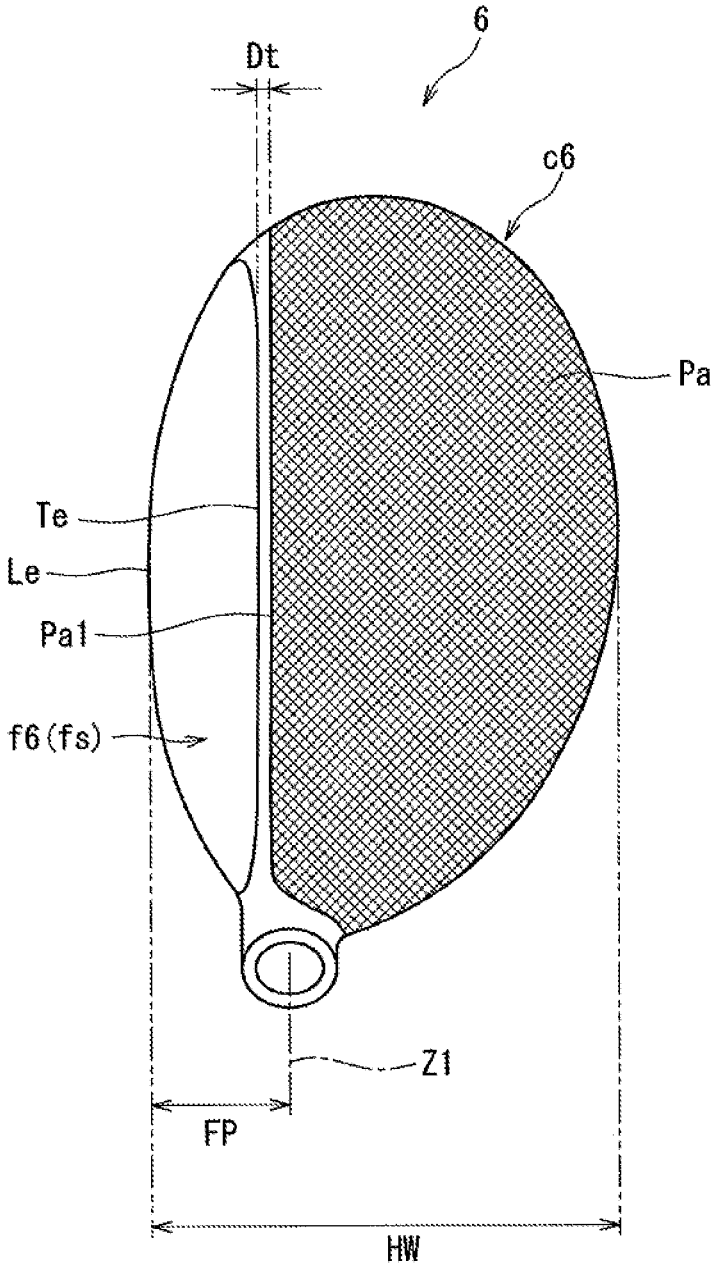
FIG. 11 is a plan view of the head of FIG. 3.

FIG. 11 is a plan view of the head 6. The crown c6 includes a coating part Pa. The coating part Pa is shown by crosshatching in FIG. 11. The coating part Pa is not the whole surface of the crown c6. The coating part Pa is a part of the surface of the crown c6. The forefront point of the coating part Pa is positioned at the back of a top edge Te. The top edge Te is a boundary between the surface of the crown c6 and the face surface fs. The coating part Pa is a portion to which colored coating is applied. A portion to which clear coating is applied is not the coating part Pa. A coating material containing a pigment forms colored coating.

A front end Pa1 of the coating part Pa is positioned at the back of the top edge Te. The front end Pa1 forms a line substantially taken along the top edge Te. The coating part Pa is provided on the whole crown c6 excluding a portion between the front end Pa1 and the top edge Te.

In the planar view (FIG. 11), the front end Pa1 includes a straight line part. The straight line part is substantially parallel to the toe-heel direction. The term "substantially parallel" means that an angle between the front end Pa1 and the toe-heel direction is equal to or less than ±5 degrees.

In the embodiment, the face progression FP is made to be substantially constant. In this case, in the head having a large loft angle, the face progression FP is decreased. As a result, in the head having a large loft angle, the face surface fs is apt to move to the back, and the top edge Te is apt to be positioned at the back. The position of the top edge Te is different from the conventional club. The position of the top edge Te gives uncomfortable feeling to some golf players.

Since the forefront point of the coating part Pa is positioned at the back of the top edge Te, the golf players are apt to have an illusion that the top edge Te is positioned comparatively at the front. The uncomfortable feeling can be suppressed by the visual effect.

A shortest distance between the top edge Te and the coating part Pa is shown by a double-pointed arrow Dt in FIG. 11. The distance Dt is measured along the front-back direction. In respect of the visual effect, it is not preferable that the distance Dt is too large or too small. In respect of the visual effect, the distance Dt is preferably equal to or greater than 1 mm, more preferably equal to or greater than 1.5 mm, and still more preferably equal to or greater than 2 mm. In respect of obtaining the illusion, the distance Dt is preferably equal to or less than 5 mm, and more preferably equal to or less than 4 mm.

EXAMPLES

Hereinafter, the effects of the present invention will be clarified by examples. However, the present invention should not be interpreted in a limited way based on the description of examples.

Example 1

Set Including Five Clubs

The same club set as the set 2 described above was produced. Five heads 6 (heads 61 to 65) were produced. As described above, each of the heads was produced by using a face member 6*p* and a head body 6*m*. A flat rolled material was used to produce the face member 6*p*. In the face member 6*p*, the back surface of the rolled material was subjected to CNC processing. Subsequently, the material subjected to the CNC processing was bent. A thickness distribution was formed with great accuracy by the CNC processing. The head body 6*m* was produced by lost wax precision casting. The face member 6*p* and the head body 6*m* were welded, and subjected to surface polishing. Furthermore, coating shown in FIG. 11 was applied to obtain each of the heads. These heads were attached to one end parts of commercially available carbon shafts. A grip was attached to each of the other end parts of these shafts. A club length was adjusted by the length of the shaft. Thus, the club set shown in FIG. 2 was obtained. This is a so-called utility type club set. The specifications and evaluation results of the set are shown in the following Table 1.

Comparative Example 1

Set Including Five Clubs

A mold for a head body was changed, and face progression FP or the like was changed. A set of comparative example 1 was obtained in the same manner as in example 1 except for the specifications shown in the following Table 2. The specifications and evaluation results of the set are shown in the following Table 2.

Example 2

Set Including Three Clubs

The example 1 includes five clubs. Since a club set can be constituted by at least two clubs, at least two of these five clubs can be recognized as the other set. That is, the example 1 includes a plurality of sets. For example, the example 1 includes a set constituted by three clubs U4, U5, and U6. The set was used as example 2. The specifications and evaluation results of example 2 are shown in the following Table 3.

Comparative Example 2

Set Including Three Clubs

The comparative example 1 includes five clubs. Since a club set can be constituted by at least two clubs, at least two of these five clubs can be recognized as the other set. That is, the comparative example 1 includes a plurality of sets. For example, the comparative example 1 includes a set constituted by three clubs U4, U5, and U6. The set was used as comparative example 2. The specifications and evaluation results of comparative example 2 are shown in the following Table 4.

Example 3 and Example 4

Set Including Five Clubs

A depth of a center of gravity DG was changed by using the set of example 1. A sticky resin (balance gel) was disposed in a head. The sticky resin has flowability at high temperature, and does not flow at a room temperature. The depth of the center of gravity DG was adjusted by the position of the sticky resin and the polishing of the head body. Sets of examples 3 and 4 were obtained in the same manner as in example 1 except for the above. The specifications and evaluation results of example 3 are shown in the following Table 5. The specifications and evaluation results of example 4 are shown in the following Table 6.

Comparative Example 3

Set Including Five Clubs

A depth of a center of gravity DG was changed by using the set of example 1. The depth of the center of gravity DG was adjusted by the position of a sticky resin and the polishing of a head body in the same manner as in examples 3 and 4. A set of comparative example 3 was obtained in the same manner as in example 1 except for the above. The specifications and evaluation results of comparative example 3 are shown in the following Table 7.

TABLE 1

Specifications and evaluation results of example 1

| | U3+ | U3 | U4 | U5 | U6 |
|---|---|---|---|---|---|
| Real loft angle (degree) | 17 | 19 | 21 | 23 | 25 |
| Head volume ($cm^3$) | 116 | 114 | 113 | 111 | 110 |
| Moment of inertia MI about axis line of shaft ($g \cdot cm^2$) | 4185 | 4291 | 4392 | 4407 | 4456 |

TABLE 1-continued

Specifications and evaluation results of example 1

| | U3+ | U3 | U4 | U5 | U6 |
|---|---|---|---|---|---|
| Depth of center of gravity DG based on axis line of shaft (mm) | 10.0 | 10.1 | 10.3 | 10.5 | 10.7 |
| MI difference rate (%) | 2.5 | 2.4 | 0.3 | 1.1 | — |
| MI difference amount ($g \cdot cm^2$) | 106 | 101 | 15 | 49 | — |
| Face progression FP (mm) | 15.8 | 15.8 | 16.0 | 16.0 | 16.0 |
| Head width HW (mm) | 64.0 | 64.0 | 64.0 | 64.0 | 64.0 |
| Club length (inch) | 41 | 40.5 | 40 | 39.5 | 39 |
| Club weight (g) | 323 | 327 | 331 | 335 | 339 |
| Swing balance | D0 | D0 | D0 | D0 | D0 |
| Height H2 (mm) | 18.5 | 18.7 | 18.9 | 19.2 | 19.5 |
| Consistency of impact timing | | | 4.5 | | |
| Variation in direction of hit ball (yard) | | | 7.1 | | |

TABLE 2

Specifications and evaluation results of comparative example 1

| | U3+ | U3 | U4 | U5 | U6 |
|---|---|---|---|---|---|
| Real loft angle (degree) | 17 | 19 | 21 | 23 | 25 |
| Head volume ($cm^3$) | 112 | 111 | 110 | 110 | 109 |
| Moment of inertia MI about axis line of shaft ($g \cdot cm^2$) | 3717 | 3770 | 3991 | 4097 | 4260 |
| Depth of center of gravity DG based on axis line of shaft (mm) | 7.8 | 7.2 | 6.0 | 5.3 | 4.5 |
| MI difference rate (%) | 1.4 | 5.9 | 2.7 | 4.0 | — |
| MI difference amount ($g \cdot cm^2$) | 53 | 221 | 106 | 163 | — |
| Face progression FP (mm) | 16.0 | 17.0 | 18.5 | 19.5 | 20.7 |
| Head width HW (mm) | 65.7 | 66.0 | 66.3 | 66.5 | 66.7 |
| Club length (inch) | 41 | 40.5 | 40 | 39.5 | 39 |
| Club weight (g) | 323 | 327 | 331 | 335 | 339 |
| Swing balance | D0 | D0 | D0 | D0 | D0 |
| Height H2 (mm) | 16.5 | 16.6 | 16.5 | 16.8 | 17.1 |
| Consistency of impact timing | | | 2.8 | | |
| Variation in direction of hit ball (yard) | | | 14.2 | | |

TABLE 3

Specifications and evaluation results of example 2

| | U4 | U5 | U6 |
|---|---|---|---|
| Real loft angle (degree) | 21 | 23 | 25 |
| Head volume ($cm^3$) | 113 | 111 | 110 |
| Moment of inertia MI about axis line of shaft ($g \cdot cm^2$) | 4392 | 4407 | 4456 |
| Depth of center of gravity DG based on axis line of shaft (mm) | 10.3 | 10.5 | 10.7 |
| MI difference rate (%) | 0.3 | 1.1 | — |
| MI difference amount ($g \cdot cm^2$) | 15 | 49 | — |
| Face progression FP (mm) | 16.0 | 16.0 | 16.0 |
| Head width HW (mm) | 64.0 | 64.0 | 64.0 |
| Club length (inch) | 40 | 39.5 | 39 |
| Club weight (g) | 331 | 335 | 339 |
| Swing balance | D0 | D0 | D0 |
| Height H2 (mm) | 18.9 | 19.2 | 19.5 |

TABLE 3-continued

Specifications and evaluation results of example 2

| | U4 | U5 | U6 |
|---|---|---|---|
| Consistency of impact timing | | 4.7 | |
| Variation in direction of hit ball (yard) | | 4.6 | |

TABLE 4

Specifications and evaluation results of comparative example 2

| | U4 | U5 | U6 |
|---|---|---|---|
| Real loft angle (degree) | 21 | 23 | 25 |
| Head volume ($cm^3$) | 110 | 110 | 109 |
| Moment of inertia MI about axis line of shaft ($g \cdot cm^2$) | 3991 | 4097 | 4260 |
| Depth of center of gravity DG based on axis line of shaft (mm) | 6.0 | 5.3 | 4.5 |
| MI difference rate (%) | 2.7 | 4.0 | — |
| MI difference amount ($g \cdot cm^2$) | 106 | 163 | — |
| Face progression FP (mm) | 18.5 | 19.5 | 20.7 |
| Head width HW (mm) | 66.3 | 66.5 | 66.7 |
| Club length (inch) | 40 | 39.5 | 39 |
| Club weight (g) | 331 | 335 | 339 |
| Swing balance | D0 | D0 | D0 |
| Height H2 (mm) | 16.5 | 16.8 | 17.1 |
| Consistency of impact timing | | 3.0 | |
| Variation in direction of hit ball (yard) | | 7.7 | |

TABLE 5

Specifications and evaluation results of example 3

| | U3+ | U3 | U4 | U5 | U6 |
|---|---|---|---|---|---|
| Real loft angle (degree) | 17 | 19 | 21 | 23 | 25 |
| Head volume ($cm^3$) | 116 | 114 | 113 | 111 | 110 |
| Moment of inertia MI about axis line of shaft ($g \cdot cm^2$) | 4185 | 4306 | 4440 | 4481 | 4567 |
| Depth of center of gravity DG based on axis line of shaft (mm) | 10.0 | 10.3 | 10.8 | 11.1 | 11.5 |
| MI difference rate (%) | 2.9 | 3.1 | 0.9 | 1.9 | — |
| MI difference amount ($g \cdot cm^2$) | 121 | 134 | 41 | 86 | — |
| Face progression FP (mm) | 15.8 | 15.8 | 16.0 | 16.0 | 16.0 |
| Head width HW (mm) | 64.0 | 64.0 | 64.0 | 64.0 | 64.0 |
| Club length (inch) | 41 | 40.5 | 40 | 39.5 | 39 |
| Club weight (g) | 323 | 327 | 331 | 335 | 339 |
| Swing balance | D0 | D0 | D0 | D0 | D0 |
| Height H2 (mm) | 18.5 | 18.7 | 18.9 | 19.2 | 19.5 |
| Consistency of impact timing | | | 4.0 | | |
| Variation in direction of hit ball (yard) | | | 9.2 | | |

TABLE 6

Specifications and evaluation results of example 4

| | U3+ | U3 | U4 | U5 | U6 |
|---|---|---|---|---|---|
| Real loft angle (degree) | 17 | 19 | 21 | 23 | 25 |
| Head volume ($cm^3$) | 116 | 114 | 113 | 111 | 110 |
| Moment of inertia MI about axis line of shaft ($g \cdot cm^2$) | 4150 | 4276 | 4407 | 4501 | 4617 |
| Depth of center of gravity DG based on axis line of shaft (mm) | 9.5 | 10.0 | 10.5 | 11.3 | 12.0 |
| MI difference rate (%) | 3.0 | 3.1 | 2.1 | 2.6 | — |
| MI difference amount ($g \cdot cm^2$) | 126 | 131 | 94 | 116 | — |
| Face progression FP (mm) | 15.8 | 15.8 | 16.0 | 16.0 | 16.0 |
| Head width HM (mm) | 64.0 | 64.0 | 64.0 | 64.0 | 64.0 |
| Club length (inch) | 41 | 40.5 | 40 | 39.5 | 39 |
| Club weight (g) | 323 | 327 | 331 | 335 | 339 |
| Swing balance | D0 | D0 | D0 | D0 | D0 |
| Height H2 (mm) | 18.5 | 18.7 | 18.9 | 19.2 | 19.5 |
| Consistency of impact timing | | | 3.6 | | |
| Variation in direction of hit ball (yard) | | | 11.3 | | |

TABLE 7

Specifications and evaluation results of comparative example 3

| | U3+ | U3 | U4 | U5 | U6 |
|---|---|---|---|---|---|
| Real loft angle (degree) | 17 | 19 | 21 | 23 | 25 |
| Head volume ($cm^3$) | 116 | 114 | 113 | 111 | 110 |
| Moment of inertia MI about axis line of shaft ($g \cdot cm^2$) | 4097 | 4259 | 4440 | 4501 | 4617 |
| Depth of center of gravity DG based on axis line of shaft (mm) | 9.0 | 9.8 | 10.8 | 11.3 | 12.0 |
| MI difference rate (%) | 4.0 | 4.2 | 1.4 | 2.6 | — |
| MI difference amount ($g \cdot cm^2$) | 162 | 181 | 61 | 116 | — |
| Face progression FP (mm) | 15.8 | 15.8 | 16.0 | 16.0 | 16.0 |
| Head width HW (mm) | 64.0 | 64.0 | 64.0 | 64.0 | 64.0 |
| Club length (inch) | 41 | 40.5 | 40 | 39.5 | 39 |
| Club weight (g) | 323 | 327 | 331 | 335 | 339 |
| Swing balance | D0 | D0 | D0 | D0 | D0 |
| Height H2 (mm) | 18.5 | 18.7 | 18.9 | 19.2 | 19.5 |
| Consistency of impact timing | | | 3.5 | | |
| Variation in direction of hit ball (yard) | | | 13.9 | | |

EVALUATION

Ten testers having a handicap of 10 or greater and 20 or less hit golf balls to make evaluations. Tests were conducted on a flat fairway. Each of golf players hits the ball placed on a lawn of the fairway. As the ball, trade name "XXIO XD-AERO" manufactured by Dunlop Sports Co. Ltd. was used. Each of the golf players carried out five shots with each of clubs. The following two items were evaluated.

[Consistency of Impact Timing]

Sensuous evaluation was made for the impact timing effect. The consistency of the impact timing in all the clubs in the set was evaluated at five stages of a score of one to five. As the consistency of the impact timing was strongly felt, a higher score was applied. The average values of the five testers are shown in Tables 1 to 7.

[Variation in Direction of Hit Ball]

A position of a final attainment point of the hit ball was measured for each of the shots. A horizontal displacement distance was measured in all the shots in all club numbers. The horizontal displacement distance is a distance of displacement from a target direction. Even of the ball was displaced to the right or the left, the horizontal displacement distance was set as a plus value. The average values of all the measurement values are shown in Tables 1 to 7.

Example 1 and comparative example 1 are sets including five clubs. If these are compared, example 1 is highly evaluated. Example 2 and comparative example 2 are sets including three clubs. If these are compared, example 2 is highly evaluated.

An effect of the depth of the center of gravity DG is shown in comparison of examples 1, 3, and 4. In each of the sets, the difference between the maximum and minimum values of the depth of the center of gravity DG is 0.7 mm in example 1, 1.5 mm in example 3, and 2.5 mm in example 4. As the difference in the depth of the center of gravity DG was smaller, the evaluation result was better. In examples 1, 3, and 4, the depth of the center of gravity DG was substantially constant. The evaluation results of examples 1, 3, and 4 were better than the evaluation result of comparative example 3.

Thus, the examples are highly evaluated as compared with the comparative examples. The advantages of the present invention are apparent.

The present invention can be applied to a wood type head, a utility type head, a hybrid type head, and an iron type head or the like.

The description hereinabove is merely for an illustrative example, and various modifications can be made in the scope not to depart from the principles of the present invention.

What is claimed is:

1. A golf club set comprising a plurality of golf clubs having different club lengths, wherein each of the golf clubs includes a head, a shaft, and a grip, the club length of each of the clubs is 38.5 inches or greater and 42 inches or less;

face progression is substantially constant, if a moment of inertia of the head about an axis line of the shaft is defined as MI, an MI difference ratio between the adjacent clubs is equal to or less than 3%, the number of the golf clubs in the golf club set is equal to or greater than 3, a difference between a maximum value and a minimum value of a face progression FP is equal to or less than 1 mm, in all heads of the plurality of golf clubs, a loft angle is equal to or greater than 20 degrees, wherein each of the heads includes a face, the face includes a thick part, the thick part includes thick part middle point, wherein if a height of the thick part middle point is defined as H2 the H2 is increased as the club length is decreased, and all heads of the plurality of golf clubs are hollow.

2. The golf club set according to claim 1, wherein the MI difference ratio is equal to or less than 2%.

3. The golf club set according to claim 1, wherein a volume of each of the heads is 70 $cm^3$ or greater and 150 $cm^3$ or less.

4. The golf club set according to claim 1, wherein a depth of a center of gravity based on the axis line of the shaft is substantially constant.

5. The golf club set according to claim 1, wherein the adjacent clubs mean two clubs having clubs lengths closest to each other in the plurality of golf clubs.

6. A golf club set comprising a plurality of golf clubs having different club lengths, wherein each of the golf clubs includes a head, a shaft, a face and a grip, the club length of each of the clubs is 38.5 inches or greater and 42 inches or less;

face progression is substantially constant, if a moment of inertia of the head about an axis line of the shaft is defined as MI, an MI difference ratio between the adjacent clubs is equal to or less than 3%, and in all heads of the plurality of golf clubs, a ratio of H3/H4 is greater than 1.0, wherein:

the face of each golf club includes an inclination thick part extends toward a toe lower side from a heel upper side, a heel thin part, a toe thin part, the inclination thick part being positioned between the heel thin part and the toe thin part, and a transitional part positioned between the inclination thick part and the heel and toe thin parts, the transitional part includes a first transitional part positioned between the inclination thick part and the heel thin part, and a second transitional part position between the inclination thick part and the toe thin part, H3 is defined as a height of the first transitional part measured from a point where a line extending in an up-down direction, orthogonal to a toe-heel direction, passing through a middle point of the inclination thick part intersects the first transitional part, to a point of a lower edge of the face along the up-down direction, H4 is defined as a height of the second transitional part measured from a point where the line extending in the up-down direction, orthogonal to a toe-heel direction, passing through the middle point of the inclination thick part intersects the second transitional part, to a point of an upper edge of the face along the up-down direction, and wherein a height of the thick part middle point, measured from the thick part middle point to the point of the lower edge of the face along the up-down direction, is increased as the club length is decreased.

* * * * *